United States Patent [19]

Wong

[11] 4,052,063

[45] Oct. 4, 1977

[54] MULTI-PURPOSE PROTECTION DEVICE

[76] Inventor: Michael Wong, 1647-A Leilehua Lane, Honolulu, Hawaii 96813

[21] Appl. No.: 696,066

[22] Filed: June 14, 1976

[51] Int. Cl.[2] ..... F41B 15/00

[52] U.S. Cl. ..... 273/84 R

[58] Field of Search ..... 273/67 R, 84 R; D22/1, D22/99

[56] References Cited

U.S. PATENT DOCUMENTS

| | | | |
|---|---|---|---|
| 2,099,447 | 11/1937 | Matsuyama | 273/84 R |
| 3,106,398 | 10/1963 | Gowdey | 273/84 R |
| D. 161,701 | 1/1951 | McLean | D22/1 |
| D. 204,765 | 5/1966 | Black | 273/84 R |

OTHER PUBLICATIONS

"Blackbelt;" Dec. 9, 1975; p. 19.

*Primary Examiner*—Richard J. Apley
*Attorney, Agent, or Firm*—George W. T. Loo

[57] ABSTRACT

A multi-purpose protection device with a point on one end of a shaft and a butt on the other end, two opposite facing bent prongs connected to the middle of the shaft, and a deflector knob located near the bend of each prong on the outside surface of the prong. The weapon is used in a close quarter situation. It may be held in a night stick position or in a pistol grip position. It can be readily changed from one position to the other — point to butt or pistol grip to night stick, or vice versa.

7 Claims, 5 Drawing Figures

MULTI-PURPOSE PROTECTION DEVICE

BACKGROUND OF THE INVENTION

1. Field of Invention

My invention pertains to policeman's clubs, billies, night sticks, judo sticks and riot batons.

2. Description of Prior Art

Prior art consists of policeman's billies, night sticks, judo sticks and riot batons. The present day clubs depend on overhead blows and need space to work in. My invention is capable of delivering a blow along a straight trajectory with the wrist extended in a straight forward position. When a blow is delivered, the wrist remains almost rigid. My invention is capable of delivering short, rapid, and powerful blows at a distance of 3 inches or less without changing the position or angle of the wrist.

SUMMARY OF THE INVENTION

The invention relates to a multi-purpose protection device which is capable of being used in a close quarter situation. It may be held in a night stick position or in a pistol grip position. It can be readily changed from one position to the other or reversed.

An object of this invention is to provide a self-defense weapon which is capable of delivering a blow along a straight trajectory with the wrist extended in a straight forward position.

Another object of this invention is to provide a self-defense weapon which is designed to be used at very close quarters.

Still another object of this invention is to provide a self-defense weapon which is capable of delivering two blows with one thrust.

A still another object of this invention is to provide a self-defense weapon which may be used by a man, woman or child.

Another object of this invention is to provide a self-defense weapon which protects the fingers of the user.

Still another object of this invention is to provide a self-defense weapon which can be used to deflect or entrap weapons or wrists.

A still another object of this invention is to provide a self-defense weapon which can be thrust forward with the entire arm and not merely on wrist action alone.

A further object of this invention is to provide a self-defense weapon with deflector knobs.

Another object of this invention is to provide a self-defense weapon for women who wish to protect themselves from physical harm against muggers, rapists or other criminals.

Still another object of this invention is to provide a self-defense weapon which is so compact that it could easily fit in a woman's handbag or could be worn in the standard issued club holster or mace holster.

A further object of this invention is to provide a self-defense weapon which can deliver not only overhead, side, and right angle blows, but also long and short range punches and jabs, vertically and horizontally.

Another object of this invention is to provide a self-defense weapon which can be held in a fashion similar to that of holding a pistol or handgun with the blow delivered by a forward thrust with either the point or butt end.

Other objects, features and advantages of the present invention will be readily apparent from the following detailed description taken in connection with the accompanying drawings.

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
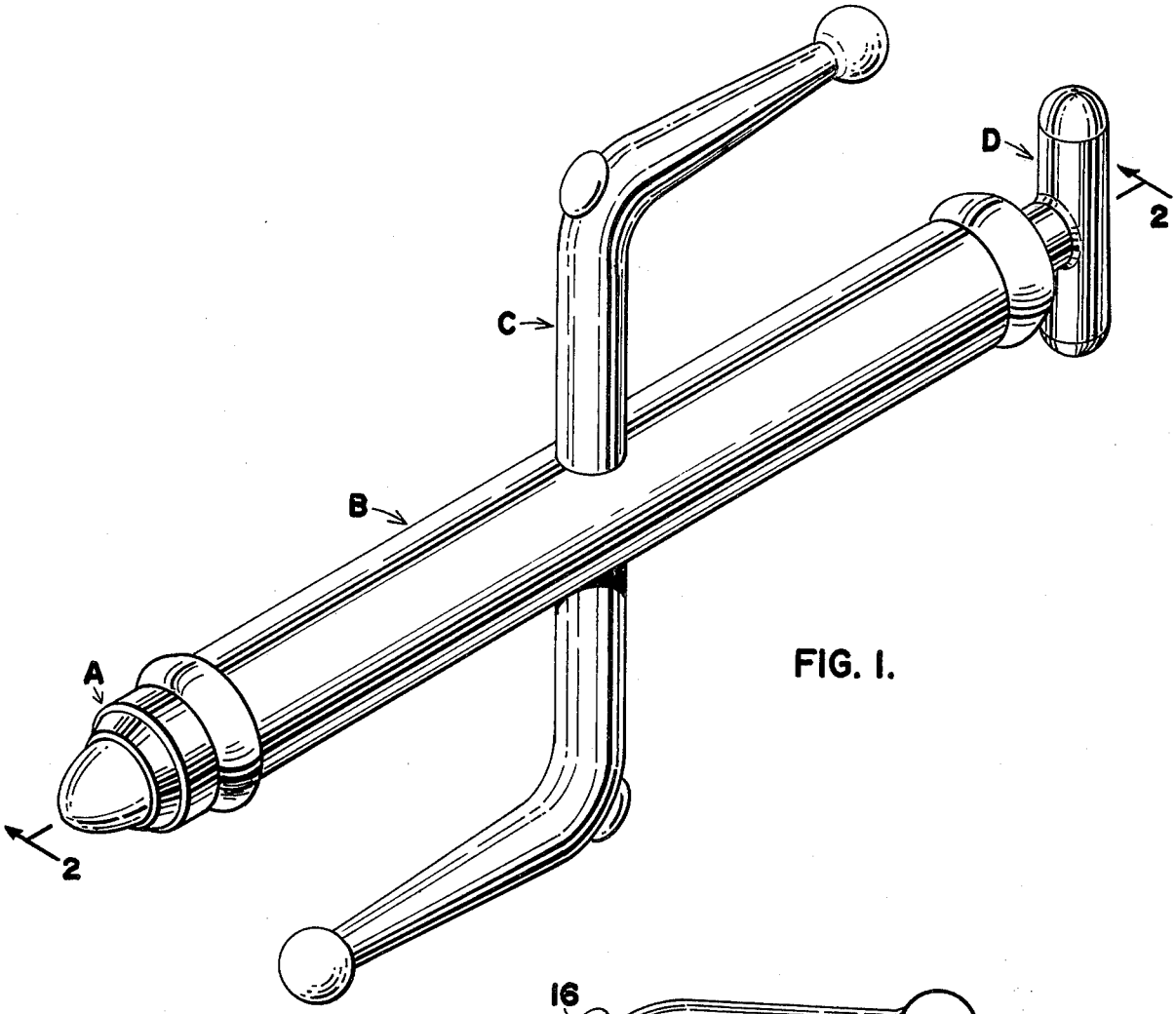
FIG. 1 is a perspective view of the invention.
Figure 2:
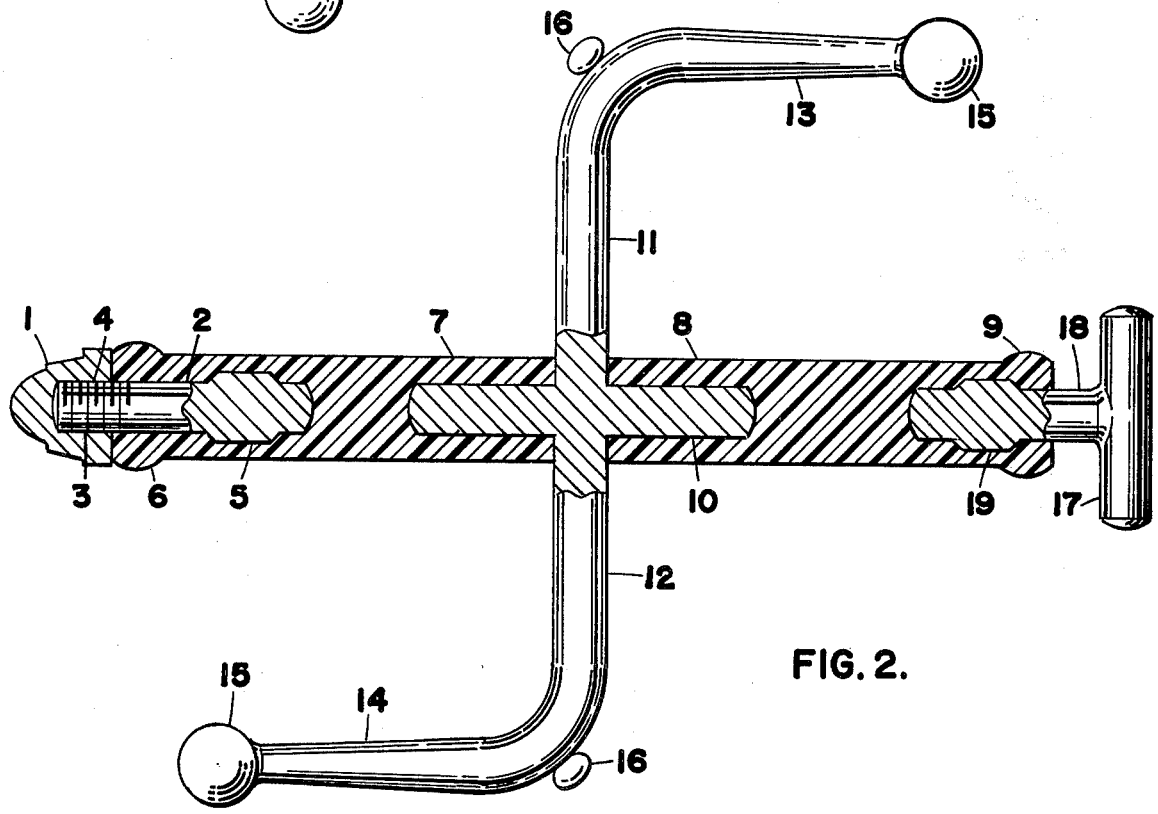
FIG. 2 is a partial perspective view of the prong assembly, butt assembly and point assembly and a sectional view of the remainder of the invention along line 2—2 of FIG. 1.
Figure 3:
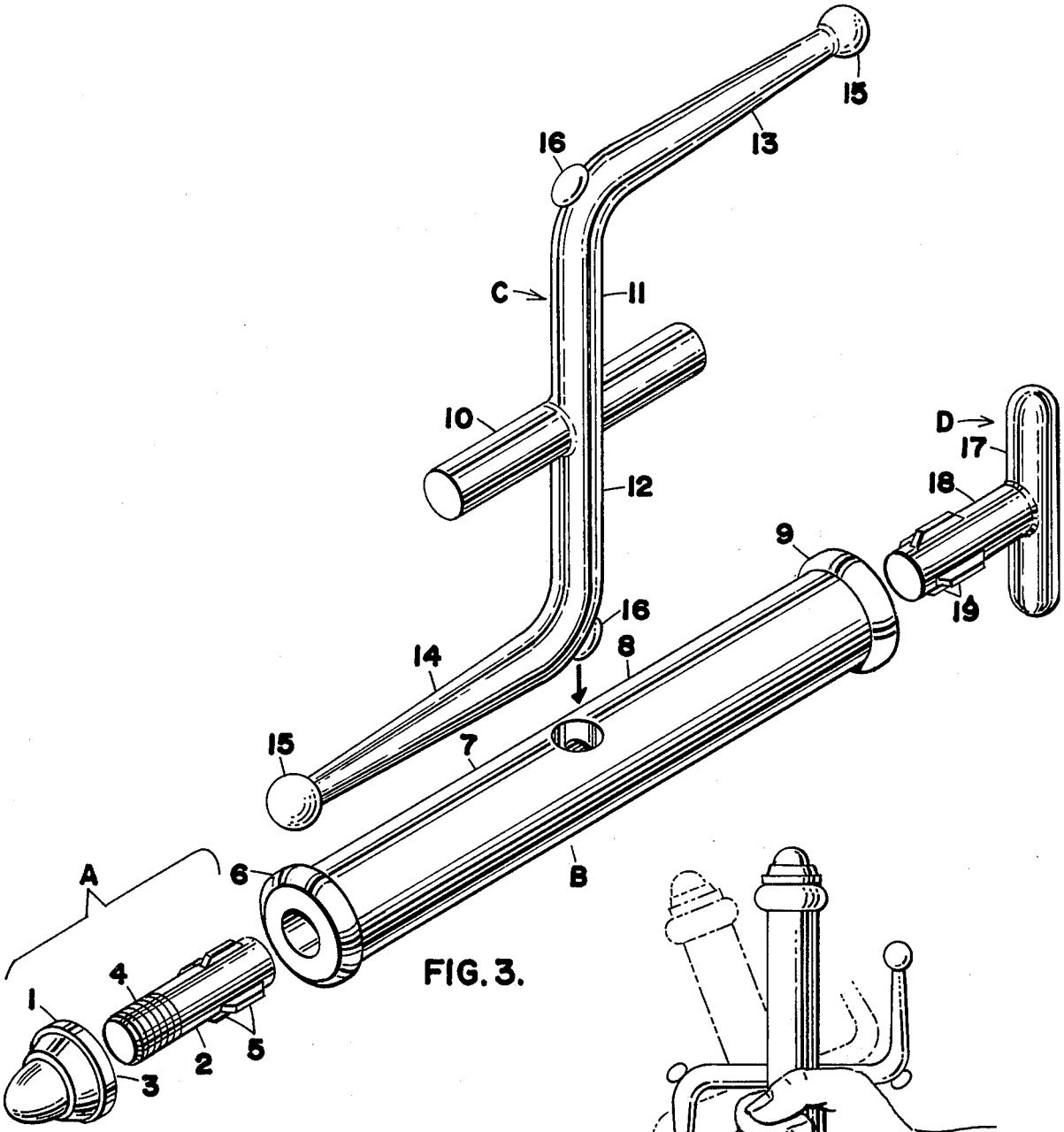
FIG. 3 is an exploded view of the parts of the invention.

Referring now to the drawings wherein like reference numerals refer to like and corresponding parts throughout the several views, the preferred embodiment of the invention disclosed in FIGS. 1 to 3 inclusive includes a point assembly A, a handle assembly B, a prong assembly C, and a butt assembly D. The point assembly A, the prong assembly C, and the butt assembly D are all made of metal. The handle assembly B is made out of plastic. The point assembly A, the prong assembly C, and the butt assembly D are joined together by the process of molding the handle assembly B onto them. (See FIG. 2)

Point assembly A includes a point 1, a stem 2, internal screw thread 3, external screw thread 4, and stem locking lugs 5. Stem 2 is screwed into point 1 by means of external screw thread 4 and internal screw thread 3.

Handle assembly B includes point handle front 6, point handle base 7, butt handle base 8, and butt handle front 9.

Prong assembly C includes a rod 10, prong bases 11 and 12, prong fronts 13 and 14, prong points 15, and deflector knobs 16. Prong bases 11 and 12 are bent in opposite directions from each other so that prong fronts 13 and 14 face in opposite directions. Prong bases 11 and 12 are bent at a 90° angle. The prong bases 11 and 12 are of sufficient length to allow the last three fingers of a person's hand to fit comfortably side by side when a pistol grip is used.

Butt assembly D includes a butt 17, a butt stem 18, and butt locking lugs 19.

In the preferred embodiment of my invention, the point assembly A, the prong assembly C, and the butt assembly D are all made of metal and the handle assembly B is made of Monpac plastic or a similar material with similar properties of strength, lightness and good gripping qualities. Metal used may be of mild tool steel, high tensile steel alloy, high tensile stainless steel or tensile aluminum.

The entire invention may be made of metal by investment forging or casting to save time and to help cut operating costs. However, the most practical and most efficient unit that would serve both the needs of police, military and civilian applications would be the unit with a Monpac plastic grip. The wider plastic grip would be easier to grip and to manipulate. The plastic mounted weapon allows for greater flexibility.

The point assembly A, the prong assembly C and the butt assembly D are joined together to form a complete unit by the process of molding the handle assembly B onto them. With the point assembly A, the prong assembly C and the butt assembly D firmly anchored to handle assembly B, it is practically impossible for any of them to work their way free after the device is subjected to prolonged use.

Point 1 may be pointed, rounded or blunted. At its base it has a diameter of 1 inch. The base is made wide so that the point tip will not brush or touch the surface of the user's arm when the device is held in the pistol grip position with butt 17 in a forward position. Point 1 is 1 inch or longer in length. With a threaded point and a threaded stem, different types of points may be used. If it is deemed desirable, the point 1 and stem 2 may be made of one piece.

Handle assembly B is round in cross section with a diameter of one inch throughout except for point handle front 6 and butt handle front 9, which are 1¼ inch in diameter. Point handle base 7 and butt handle base 8 are each 4½ inches in length. The handle assembly B may be partly or entirely grooved if a better gripping surface is desired.

The gripping areas of the plastic grip that are located within the prong assembly area must not exceed one inch in diameter; otherwise, this gripping area would be too wide to allow for a pistol grip hold. Any part of the plastic handles that extend beyond the prong assembly area may be slightly increased in diameter 1¼ inch on devices exceeding 11½ inches in length, to improve gripping and to improve the overall balance.

Rod 10 and prong bases 11 and 12 are round in cross section with a diameter of one-half inch. Prong fronts 13 and 14 taper toward prong points 15. Prong points 15 have a diameter of three-fourths inch. The prong bases 11 and 12 should be of sufficient length to allow the last three fingers of a person holding the device in a pistol grip to fit comfortably side by side along the prong base.

In my preferred embodiment the length of prong bases 11 and 12 in 2½ inches and the length of prong fronts 13 and 14 to prong points 15 is three inches. The length of the prong fronts 13 and 14 to prong points 15 may be increased to further protect the fingers of the person grasping the device.

Prong fronts 13 and 14 are approximately parallel to each other and face in opposite directions to each other. The reason for the prong fronts 13 and 14 facing in opposite direction to each other is to provide protection to the user of the device when it is held in the forward or rearward pistol grip hold. Prong points 15 are rounded to reduce the hazard of cutting and injuring a person struck therewith. They may be pointed if it is desired to inflict serious cutting and injury to an adversary.

Prong fronts 13 and 14 and prong points 15 may be used to hook onto the clothing of an adversary.

Deflector knobs 16 prevent a staff or long cutting edge weapon from sliding over the prong fronts 13 and 14 to inflict injury to the fingers or to the wrist of the person using the device to block an overhead or side blow with the prong fronts 13 and 14. Deflector knobs are one-half inch in diameter.

Butt 17 is round in cross section with a diameter of one/half inch. The ends are rounded off to prevent serious injury to an opponent. It is two inches in length. Two inches is roughly equal to the width of three fingers fully extended. It is used to deliver a straight finger or spear thrust.

The main target of butt 17 are the soft and vulnerable parts of the anatomy. A blow from the forward part of butt 17 can be executed facing horizontally or vertically: horizontally — neck, vertically — arm pit, solar plexus. It is used strictly for stunning an opponent.

In the pistol grip position, butt 17 acts as a stabilizer to guide point 1 to the target. The principle is similar to the steadying hold of a rifle butt.

Figure 4:
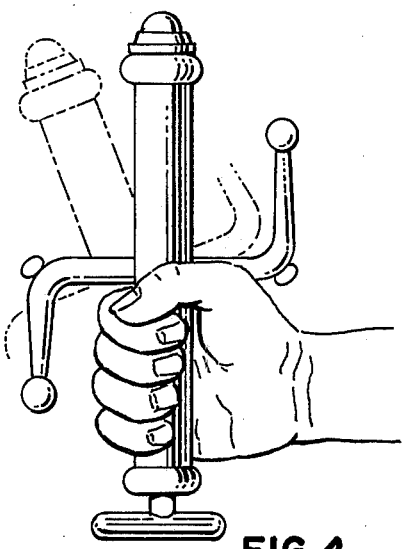
FIG. 4 is a perspective view of the invention being held in a night stock position.
Figure 5:
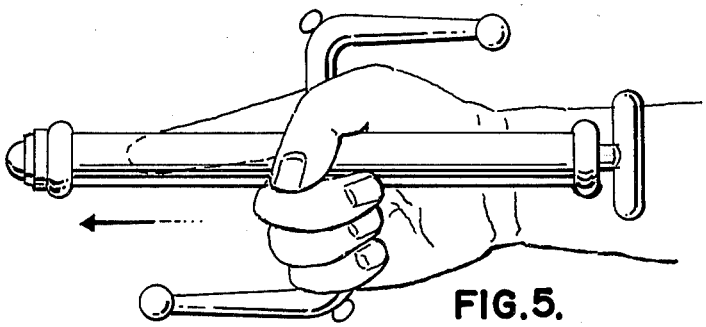
FIG. 5 is a perspective view of the invention being held in a pistol grip position.

My invention may be held in a night stick position (FIG. 4) or in the pistol grip position (FIG. 5). For the night stick position, the device is grasped with the hand around the butt handle base 8, or around point handle base 7. It can also be held upside down by grasping the point handle base 7, without reversing the direction of point 1. For the pistol grip position, place the prong base 11 in the V formed by the thumb and forefinger of the user, curl the thumb so that it rests on portions of prong base 11 and point handle base 7, extend the forefinger in a straight almost rigid position along the point handle base 7, and grip prong base 12 with the last three fingers. The device can be readily reversed by flipping it. It can be flipped to change positions, point to butt, or pistol grip to night stick or vice versa.

My invention may be entirely coated or insulated with rubber, fiberglass, vinyl, nylon or some other shock absorbent material to lessen the chance of injury, if it is deemed desirable to do so.

My invention may be carried in a woman's handbag, in a club holster or in a mace holster. In a holster my device is carried with the point protruding through the bottom of the holster and with butt 17 and butt handle base 8 secured to the holster by a narrow leather flap which snaps over the prong base 11.

My invention is 11½ inches in length. It may be increased to 24 inches if it is deemed desirable to do so. If the length is increased, the length of butt 17 may be reduced from two inches to one inch as with the increased length of the device, butt 17 will no longer be used as a stabilizer to guide the device and as it makes it much easier to grip the device in the classic two-handed position in rifle-bayonet or kendo fashion. The diameter of the handle assembly B may be increased to 1¼ inches on longer models to greatly improve the gripping characteristics of the device and to improve their overall balance.

In the preferred embodiment, my device is only 11½ inches in length. When it is held in the pistol grip position, only 2 inches or less of the device is exposed with the rest of the device concealed, thereby presenting an element of surprise to an adversary.

My invention is designed to be maneuvered at very close quarters in tight or guarded situations. Consequently, it should be as small as possible. I have been able to reduce its length to 11½ inches and yet provide a devastating self-defense weapon. It could be reduced further if it is deemed desirable to do so.

My invention can deliver overhead, side and right angle blows. It can also deliver long and short range punches and jabs vertically and horizontally. It is capable of delivering a blow along a straight trajectory with the wrist extended in a straight forward position. It can be used from practically any angle, position or distance within its range. It is really as easy to use as pointing your finger. Your forefinger is on the trigger (handle) at all times!

My invention can deliver a series of short, rapid and powerful blows at a distance of three inches or less without changing the position or angle of the wrist. When a blow is delivered, the wrist remains almost completely rigid. It can be manipulated from a reclining, prone or sitting position.

Because of the unique construction of the prongs, the amount of kinetic energy applied on the forward thrust is almost double the force of a thrust generated by other conventional means. This is made possible because the forward thrust is generated with the entire arm and not merely on wrist action alone. The forefinger in the extended position is always pointed at the target. Because most women lack the physical power and stamina necessary to deliver strong, powerful blows to an adversary, my invention is particularly suited for women who wish to protect themselves from physical harm from muggers, rapists or other criminals.

My invention can be used to deliver two blows with one thrust. In addition to the blow from the forward thrust, a karate-like blow can be executed at very close quarters with a short, fast, powerful flick of the wrist. Prong points 15 are used to deliver the blow. Also, if the forward thrust blow misses its target, the forward prong may be utilized to execute a karate-like blow. If the point 1 or butt 17 should miss striking the target, prong point 15 of the forward prong could score — a backup unit.

The forward prong of my invention can be used to hook onto a person's clothing, belt, arm or wrist to incapacitate the person.

My invention can be held in upside down night stick position. Instead of grasping the butt handle base 8 as shown in FIG. 4, the point handle base 7 is grasped. In this upside down position, it could be used with devastating effect.

My invention can be manipulated in almost the same fashion as the Sai, standard police billy club and riot baton, depending on the models and the length of the device. Aside from the pistol grip position, it can be wielded as a short quarter staff utilizing any of the prongs to block or entrap an opponent's weapon to disarm him.

My invention may be designed with quick, detachable handles which fold in or will unscrew at the prong assembly into three separate parts for transportation. Point handle with point permanently secured, butt handle with butt permanently secured, and the prong assembly. Even when unassembled, anyone of the three parts could still be used as a separate weapon. Also in its unassembled form, my invention would not come under the category of a concealed weapon.

Although but a single embodiment of the invention has been disclosed and described herein, it is obvious that many changes may be made in the size, shape, arrangement and detail of the various elements of the invention without departing from the scope of the novel concepts of the present invention.

I claim as my invention:

1. A multi-purpose protection device comprising a shaft with a point on one end and a butt on the other end and two bent prongs at the middle portion of the shaft, the prongs are bent in opposite direction from each other, each of the prongs being of such size and configuration that the last three fingers of a person's hand will fit along the base of the prong.

2. The device of claim 1, wherein a deflector knob is located near the bend of each prong on its outside surface.

3. The device claim 1, wherein the two prongs are secured to the center of the shaft and the prong fronts are approximately parallel to each other.

4. The device of claim 2, wherein the shaft has two handle portions, one on each side of the prongs, each handle portion is of a length sufficient to accommodate a person's clenched hand, and of a diameter to be held in his clenched hand.

5. The device of claim 4, wherein the diameter of the prongs is less than the diameter of the two handle portions.

6. The device of claim 1, wherein the shaft is substantially round in cross section and has two hand portions, one on each side of the prongs, each handle portion is of a length sufficient to accommodate a person's clenched hand and of a diameter to be held in his clenched hand.

7. The device of claim 5, wherein the two handle portions are of different lengths, the point handle portion being longer in length.

* * * * *